US005954891A

United States Patent [19]

Kondoh et al.

[11] Patent Number: 5,954,891

[45] Date of Patent: Sep. 21, 1999

[54] DETERGENT COMPOSITION FOR REMOVING RESINOUS STAINS

[75] Inventors: Junji Kondoh; Eiji Kashihara, both of Wakayama, Japan

[73] Assignee: Kao Corporation, Tokyo, Japan

[21] Appl. No.: 09/004,285

[22] Filed: Jan. 8, 1998

[30] Foreign Application Priority Data

Jan. 9, 1997 [JP] Japan ..... 9-014477

[51] Int. Cl.[6] ..... B08B 3/04; C11D 1/72; C11D 3/04; C11D 3/20

[52] U.S. Cl. ..... 134/40; 510/163; 510/170; 510/179; 510/182; 510/435; 510/475; 510/506

[58] Field of Search ..... 510/163, 170, 510/179, 182, 435, 475, 506; 134/40, 42

[56] References Cited

U.S. PATENT DOCUMENTS

| | | | |
|---|---|---|---|
| 5,190,595 | 3/1993 | Ameen et al. | 134/40 |
| 5,336,445 | 8/1994 | Michael et al. | 252/548 |
| 5,454,983 | 10/1995 | Micheal et al. | 252/545 |
| 5,536,439 | 7/1996 | Harbin | 510/212 |
| 5,538,662 | 7/1996 | Klier et al. | 252/122 |
| 5,604,192 | 2/1997 | Michael et al. | 510/180 |
| 5,783,538 | 7/1998 | Totoki | 510/197 |

FOREIGN PATENT DOCUMENTS

| | | |
|---|---|---|
| 0743359A1 | 11/1996 | European Pat. Off. . |
| 2847691A1 | 5/1980 | Germany . |
| 4359257 | 12/1992 | Japan . |
| 5-051599 | 3/1993 | Japan . |
| 5269448 | 10/1993 | Japan . |
| 5-306481 | 11/1993 | Japan . |
| 5-306482 | 11/1993 | Japan . |
| 6-041587 | 2/1994 | Japan . |
| 8224740 | 9/1996 | Japan . |
| 9003486 | 1/1997 | Japan . |
| 9-241685 | 9/1997 | Japan . |
| 2146349 | 4/1985 | United Kingdom . |
| 2266725 | 11/1993 | United Kingdom . |
| WO9638522 | 5/1996 | WIPO . |

*Primary Examiner*—Yogendra Gupta
*Assistant Examiner*—Gregory R. Delcotto
*Attorney, Agent, or Firm*—Birch, Stewart, Kolasch & Birch, LLP

[57] ABSTRACT

A detergent composition for removing resinous stains including (a) an aromatic compound represented by the general formula (1); and (b) an alkylene oxide compound represented by the general formula (2); and optionally including (c) an alkali metal hydroxide; and (d) water.

10 Claims, No Drawings

DETERGENT COMPOSITION FOR REMOVING RESINOUS STAINS

BACKGROUND OF THE INVENTION

1. Field of the Invention

The present invention relates to a detergent composition for removing resinous stains, and more particularly to a detergent composition exhibiting excellent removability against difficult-to-remove resinous stains adhered to surfaces of hard materials, such as plastic lens resins, tackifiers, paints, ink cured products, adhesives for temporary fixing, fixing agents, bonding agents, sealing agents, binders, and protective films. In addition, the present invention relates to a method for removing resinous stains, more particular to a method for removing resinous stains which are ascribed to one or more members selected from plastic lens resins, adhesives, and tackifiers adhered to plastic lens or adhered to glass molds, jigs and tools usable in the production process of the plastic lens.

2. Discussion of the Related Art

The resinous stains, which are ascribed to one or more members selected from plastic lens resins, adhesives, tackifiers, and the like, adhered to optical parts, such as plastic lens, or resinous materials, and to glass molds, jigs and tools usable in the production processes of the plastic lens; paints, such as body coatings upon color changes in automobile production, paints adhered to jigs for painting, paints for automobile bumpers for recycling and reuse, paints for constructions, such as sash made of aluminum and buildings; ink cured products adhered to printing machines during printing, such as gravure, and the like; resists using producing electronic parts or for metal process products, such as semiconductors and lead-frames; resins such as adhesives for temporary fixing, fixing agents, bonding agents, sealing agents, and the like, which are adhered to semiconductor and crystalline materials such as silicon, gallium arsenide, and gallium phosphide, electronic part-related materials such as crystals, quartz, glass, and piezoelectric element, magnetic materials such as ferrite and samarium cobalt, magnetic member materials such as magnetic heads, electronic parts such as chip-type electronic parts, electric parts or precision machine parts, such as liquid crystal color filters and printed wiring boards, or adhered to jigs and tools usable in the processing and production processes thereof; and resins, such as binders, paints, and protective films removed during recycling of the above parts, are firmly adhered or bonded to surfaces of hard materials and the resinous stains themselves are ascribed to resins having high molecular weights, thereby making it extremely difficult to conduct cleaning with chemicals utilizing actions such as dissolution swelling, softening, flecking, and peeling. In particular, the resinous stains ascribed to plastic lens and adhered to glass molds during the production of the plastic lens have extremely high molecular weights, so that it is considered to be one of the most difficult-to-remove resinous stains.

The resins usable for plastic lens include resins obtained by radical polymerization of diethylene glycol bis(allyl carbonate) (ADC), methacrylic resins, copolymer resins of fumaric acid ester-allyl monomer, triazine cyclic acrylic resins, polycarbonate resins, bromine-containing resins, urethane resins, sulfur-containing urethane resins, thioether-ester resins, and the like.

A general method for producing plastic lens comprises pouring monomeric forming materials in a cast mold formed by cyclic packing (gasket) or tape comprising two glass molds and a synthetic resin wrapping around the peripheral portion of the glass molds, and subsequently polymerizing the monomeric components with heating. After the polymerization process, the cyclic packing or tape is removed from the cast mold, and the plastic lens resins are taken out of the glass molds. Since resulting plastic lens have a non-uniform shape in the peripheral portions thereof, the peripheral portions are reshaped, and subsequently chamfering of the edge portion is conducted. The chamfered plastic lens are conveyed to a vessel for the cleaning process.

After removing the oligomeric stains and the polymeric stains adhered to lens surfaces during removal of the packing from the molds, the polymer powder adhered during peripheral reshaping and chamfering, unreacted monomers remaining on lens surfaces, powdery dusts in the atmosphere, and the like, are subjected to cleaning, and the cleaned plastic lens are subjected to surface treatments such as dyeing, hard coat, reflection-preventive coat and aqua coat to prepare a commercial product thereof.

Since the glass molds usable in the production of the plastic lens are extremely expensive, the glass molds are repeatedly used for several hundred times to several thousand times as long as they do not crack. Therefore, it is necessary to remove oligomeric or polymeric stains ascribed to the starting materials of the plastic lens dropping out from the glass molds when pouring the monomeric components. Unless the glass molds are clean, it would be impossible to produce high-quality plastic lens with smooth surfaces, and such glass molds which cannot produce smooth surface plastic lens must be disposed as wastes, thereby making it extremely economically disadvantageous.

Conventionally, in order to remove oligomeric or polymeric stains formed on the glass molds usable in the production of the plastic lens, alkaline detergents, having sodium hydroxide or potassium hydroxide as a main component, and methylene chloride have been used.

Among the conventionally used detergents, the alkaline detergent does not give sufficient removability, requiring a long period of time to completely remove stains. In addition, it is necessary remove the stains by hand. In addition, the methylene chloride by itself is also deficient in removability of dirt stains, so that in some cases the methylene chloride is used together with the alkaline detergent. Moreover, since it is possible that the methylene chloride is a carcinogen, strict regulations are in place to prevent its leakage into waste water or the atmosphere. Therefore, the reduction and banning of its use have been in demand.

In the process of removing of oligomeric or polymeric stains formed on the plastic lens or the glass molds, Japanese Patent Laid-Open No. Hei 5-269448, for instance, discloses a process of cleaning plastic lens and glass molds to which stains are adhered comprising dispersing monomers in a solvent, subjecting the stains to an ultrasonic cleaning, liquid or vaporous shower cleaning, and stir-cleaning. However, in this cleaning process, the larger the molecular weight of the resinous stains, the more period of time is necessitated in dissolution and dispersion, so that sufficient removability cannot be achieved.

In addition, a cleaning process of other resinous stains are disclosed in Japanese Patent Laid-Open No. Hei 4-359257 pertaining to a peeling solution for removing an alkali-developing type photoresist film, comprising a peeling solution for etching a resist film comprising an alkali metal hydroxide or an alkali metal silicate, a benzyl alcohol, and water as essential components for photoetching. However, this peeling liquid is applicable to only alkali-developing type photoresist films, and it cannot be applied to resists conventionally peeled with chlorine-containing solvents, having higher degrees of polymerization.

Accordingly, an object of the present invention is to provide a detergent composition having excellent removability against resinous stains and excellent safety.

Another object of the present invention is to provide a method for removing resinous stains using the detergent composition.

These and other objects of the present invention will be apparent from the following description.

SUMMARY OF THE INVENTION

In sum, the present invention pertains to the following.

[1] A detergent composition for removing resinous stains comprising:

(a) 50 to 95% by weight of an aromatic compound represented by the general formula (1):

(1)

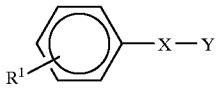

wherein $R^1$ is hydrogen atom or a hydrocarbon group having 1 to 4 carbon atoms; X is O, $CH_2O$, C═O, or $(CH_2)_k$; Y is OH, $R^2$, or $(R^3O)_jH$; $R^2$ is a hydrocarbon group having 1 to 7 carbon atoms; $R^3$ is an alkylene group having 2 to 3 carbon atoms; k is an integer of 1 or 2; and j is an integer of 1 to 8; and (b) 5 to 50% by weight of an alkylene oxide compound represented by the general formula (2):

$$R^4—O—(R^5—O)_m—R^6,$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; and m is an integer of 1 to 8;

[2] The detergent composition described in item [1] above, further comprising a water-soluble polyhydric alcohol;

[3] The detergent composition described in item [1] or item [2] above, wherein the resinous stains are from one or more members selected from the group consisting of plastic lens resins, adhesives, and tackifiers adhered to plastic lens or adhered to glass molds, jigs and tools usable in the production process of the plastic lens;

[4] A detergent composition for removing resinous stains comprising:

(a) 10 to 94% by weight of an aromatic compound represented by the general formula (1):

(1)

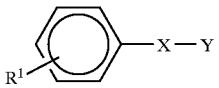

wherein $R^1$ is hydrogen atom or a hydrocarbon group having 1 to 4 carbon atoms; X is O, $CH_2O$, C═O, or $(CH_2)k$; Y is OH, $R^2$, or $(R^3O)H$; $R^2$ is a hydrocarbon group having 1 to 7 carbon atoms; $R^3$ is an alkylene group having 2 to 3 carbon atoms; k is an integer of 1 or 2; and j is an integer of 1 to 8; and (b) 0.5 to 47% by weight of an alkylene oxide compound represented by the general formula (2):

$$R^4—O—(R^5—O)_m—R^6,$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; and m is an integer of 1 to 8;

(c) 0.5 to 30% by weight of an alkali metal hydroxide; and (d) 5 to 80% by weight of water;

[5] The detergent composition described in item [4] above, further comprising a water-soluble polyhydric alcohol;

[6] The detergent composition described in item [4] or item [5] above, wherein the resinous stains are from one or more members selected from the group consisting of plastic lens resins, adhesives, and tackifiers adhered to plastic lens or adhered to glass molds, jigs and tools usable in the production process of the plastic lens;

[7] A process for removing resinous stains comprising the steps of:

(A) cleaning an object to which resinous stains are adhered using the detergent composition as defined in item [1] or item [2] above;

(B) cleaning the cleaned object obtained in step (A) with an alkaline detergent containing 0.5 to 30% by weight of an alkali metal hydroxide; and (C) rinsing the cleaned object obtained in step (B) with rinsing water;

[8] The process described in item [7] above, wherein the object to be cleaned is plastic lens or glass molds, jigs and tools usable in the production process of the plastic lens, and wherein the resinous stains are from one or more members selected from the group consisting of plastic lens resins, adhesives, and tackifiers;

[9] A process for removing resinous stains comprising the steps of:

(D) cleaning an object to which resinous stains are adhered using the detergent composition as defined in item [4] or item [5] above; and (E) rinsing the cleaned object obtained in step (D) with rinsing water; and

[10] The process described in item [9] above, wherein the object to be cleaned is plastic lens or glass molds, jigs and tools usable in the production process of the plastic lens, and wherein the resinous stains are from one or more members selected from the group consisting of plastic lens resins, adhesives, and tackifiers.

DETAILED DESCRIPTION OF THE INVENTION

The present invention will be described in detail hereinbelow.

1. The detergent composition for removing resinous stains of the present invention There are two embodiments [A] and [B] for the detergent compositions for removing resinous stains of the present invention:

Detergent Composition [A] comprises:

(a) 50 to 95% by weight of an aromatic compound represented by the general formula (1):

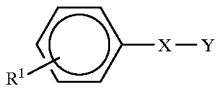

(1)

wherein $R^1$ is hydrogen atom or a hydrocarbon group having 1 to 4 carbon atoms; X is O, $CH_2O$, C═O, or $(CH_2)k$; Y is OH, $R_2$, or $(R^3O)_jH$; $R^2$ is a hydrocarbon group having 1 to 7 carbon atoms; $R^3$ is an alkylene group having 2 to 3 carbon atoms; k is an integer of 1 or 2; and J is an integer of 1 to 8; and (b) 5 to 50% by weight of an alkylene oxide compound represented by the general formula (2):

$$R^4—O—(R^5—O)_m—R^6,$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; m is an integer of 1 to 8.

The detergent composition [B] comprises:

(a) 10 to 94% by weight of an aromatic compound represented by the general formula (1):

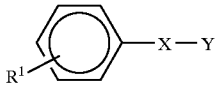

(1)

wherein $R^1$ is hydrogen atom or a hydrocarbon group having 1 to 4 carbon atoms; X is O, $CH_2O$, C═O, or $(CH_2)_k$; Y is OH, $R^2$, or $(R^3O)_jH$; $R^2$ is a hydrocarbon group having 1 to 7 carbon atoms; $R^3$ is an alkylene group having 2 to 3 carbon atoms; k is an integer of 1 or 2; and j is an integer of 1 to 8;

(b) 0.5 to 47% by weight of an alkylene oxide compound represented by the general formula (2):

$$R^4—O—(R^5—O)_m—R^6$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; m is an integer of 1 to 8;

(c) 0.5 to 30% by weight of an alkali metal hydroxide; and (d) 5 to 80% by weight of water.

Detergent Composition [A]

Component (a) is an aromatic compound represented by the general formula (1). Concrete examples of the hydrocarbon groups having 1 to 4 carbon atoms represented by $R^1$ include linear, saturated hydrocarbon groups, such as methyl group, ethyl group, propyl group, butyl group, and the like; branched, saturated hydrocarbon groups, such as isopropyl group, isobutyl group, t-butyl group, and the like; linear, unsaturated hydrocarbon groups, such as vinyl group, allyl group, propenyl group, butenyl group, and the like; branched, unsaturated hydrocarbon groups, such as isopropenyl group, and the like; cyclic, saturated hydrocarbon groups, such as cyclopropyl group, cyclobutyl group, and the like; and cyclic, unsaturated hydrocarbon groups, such as cyclopropenyl group, cyclobutenyl group, and the like.

Concrete examples of the hydrocarbon groups having 1 to 7 carbon atoms represented by $R^2$ include linear, saturated hydrocarbon groups, such as methyl group, ethyl group, propyl group, butyl group, pentyl group, hexyl group, heptyl group, and the like; branched, saturated hydrocarbon groups, such as isopropyl group, isobutyl group, t-butyl group, and the like; linear, unsaturated hydrocarbon groups, such as vinyl group, allyl group, propenyl group, butenyl group, pentenyl group, hexenyl group, heptenyl group, and the like; branched, unsaturated hydrocarbon groups, such as isopropenyl group, and the like; cyclic, saturated hydrocarbon groups, such as cyclopropyl group, cyclobutyl group, cyclopentyl group, cyclohexyl group, cycloheptyl group, and the like; and cyclic, unsaturated hydrocarbon groups, such as cyclopropenyl group, cyclobutenyl group, cyclopentenyl group, cyclohexenyl group, cycloheptenyl group, and the like.

Concrete examples of the alkylene groups having 2 to 3 carbon atoms represented by $R^3$ include ethylene group, propylene group, and the like. In addition, in the general formula (1), it is more desired that at least one of the groups represented by X and the groups represented by Y contain oxygen atom or oxygen atoms. Also, the preferred j is from 2 to 4.

Concrete examples of the above aromatic compounds include the following compounds:

(1) Alkylbenzenes, such as ethylbenzene, propylbenzene, butylbenzene, pentylbenzene, hexylbenzene, heptylbenzene, octylbenzene, nonylbenzene, and the like.

(2) Alcohols, such as benzyl alcohol, 4-ethylbenzyl alcohol, β-phenylethyl alcohol, and the like.

(3) Ethers, such as anisole, phenetole, isopropyl phenyl ether, butyl phenyl ether, cyclohexyl phenyl ether, benzyl methyl ether, benzyl ethyl ether, benzyl isopropyl ether, benzyl butyl ether, benzyl cyclohexyl ether, benzyl phenyl ether, cresyl methyl ether, diphenyl ether, dibenzyl ether, and the like.

(4) Ketones, such as acetophenone, p-methylacetophenone, ethyl phenyl ketone, isopropyl phenyl ketone, butyl phenyl ketone, cyclohexyl phenyl ketone, benzyl methyl ketone, benzyl ethyl ketone, benzyl isopropyl ketone, benzyl butyl ketone, benzyl cyclohexyl ketone, benzyl phenyl ketone, diphenyl ketone, dibenzyl ketone, and the like.

(5) Glycol ether compounds, such as $(POE)_{1-8}$ monophenyl ether, $(POE)_{1-8}$ monobenzyl ether, $(POP)_{1-8}$ monophenyl ether, $(POP)_{1-8}$ monobenzyl ether, and the like.

The above aromatic compounds may be used alone or in combination of two or more kinds.

Among the above aromatic compounds, from the aspects of removing performance of resinous stains and availability, a preference is given to ethylbenzene, benzyl alcohol, 4-ethylbenzyl alcohol, β-phenylethyl alcohol, anisole, phenetole, isopropyl phenyl ether, butyl phenyl ether, benzyl methyl ether, benzyl ethyl ether, benzyl isopropyl ether, benzyl butyl ether, acetophenone, p-methylacetophenone, ethyl phenyl ketone, isopropyl phenyl ketone, benzyl methyl ketone, benzyl ethyl ketone, benzyl isopropyl ketone, benzyl butyl ketone, benzyl phenyl ketone, $(POE)_{1-3}$ monophenyl ether, $(POE)_{1-3}$ monobenzyl ether, $(POP)_{1-3}$ monophenyl ether, and $(POP)_{1-3}$ monobenzyl ether.

Component (b) is an alkylene oxide compound represented by the general formula (2). It is preferred that $R^4$ is an alkyl group having 3 to 6 carbon atoms or allyl group. From the aspects of inhibiting a decrease in solubility to water and inhibiting an increase in viscosity, it is desired that the number of carbon atoms in the alkyl group is not more than 8.

Concrete examples of the alkyl groups and allyl group represented by $R^4$ include methyl group, ethyl group, propyl group, isopropyl group, allyl group, butyl group, isobutyl group, hexyl group, 2-ethylhexyl group, octyl group, and the like. Concrete examples of the alkylene groups having 2 to 4 carbon atoms represented by $R^5$ include ethylene group, propylene group, butylene group, and the like. Concrete examples of the alkyl groups each having 1 to 4 carbon atoms and the acyl groups each having 1 to 4 carbon atoms represented by $R^6$ include alkyl groups, such as methyl group, ethyl group, propyl group, butyl group, and the like; and acyl groups, such as formyl group, acetyl group, propionyl group, butyryl group, and the like. m is an integer of from 1 to 8, preferably from 1 to 4. From the aspect of inhibiting an increase in viscosity, it is desired that m is an integer of not more than 8.

Concrete examples of the above alkylene oxide compounds include the following compounds:

Ethylene glycol monoethers, such as monoethylene glycol monomethyl ether, diethylene glycol monomethyl ether, triethylene glycol monomethyl ether, tetraethylene glycol monomethyl ether, pentaethylene glycol monomethyl ether, hexaethylene glycol monomethyl ether, heptaethylene glycol monomethyl ether, octaethylene glycol monomethyl ether (The above compounds may be respectively abbreviated as $(POE)_1$ monomethyl ether, $(POE)_2$ monomethyl ether, $(POE)_3$ monomethyl ether, $(POE)_4$ monomethyl ether, $(POE)_5$ monomethyl ether, $(POE)_6$ monomethyl ether, $(POE)_7$ monomethyl ether, and $(POE)_8$ monomethyl ether; or alternatively, the above compounds may be collectively referred to as $(POE)_{1-8}$ monomethyl ethers. Incidentally, similar compounds may be respectively expressed by the terminologies corresponding to above.), $(POE)_{1-8}$ monoethyl ethers, $(POE)_{1-8}$ monopropyl ethers, $(POE)_{1-8}$ monoisopropyl ethers, $(POE)_{1-8}$ monoallyl ethers, $(POE)_{1-8}$ monobutyl ethers, $(POE)_{1-8}$ monoisobutyl ethers, $(POE)_{1-8}$ monohexyl ethers, $(POE)_{1-8}$ mono-2-ethylhexyl ethers, $(POE)_{1-8}$ monooctyl ethers, and the like.

Ethylene glycol diethers, such as $(POE)_{1-8}$ dimethyl ethers, $(POE)_{1-8}$ diethyl ethers, $(POE)_{1-8}$ dipropyl ethers, $(POE)_{1-8}$ dibutyl ethers, $(POE)_{1-8}$ diisobutyl ethers, $(POE)_{1-8}$ diallyl ethers, $(POE)_{1-8}$ ethyl methyl ethers, $(POE)_{1-8}$ butyl methyl ethers, $(POE)_{1-8}$ 2-ethylhexyl methyl ethers, $(POE)_{1-8}$ isopropyl methyl ethers, $(POE)_{1-8}$ isopropyl ethyl ethers, and the like.

Propylene glycol monoethers, such as $(POP)_{1-8}$ monomethyl ethers, $(POP)_{1-8}$ monoethyl ethers, $(POP)_{1-8}$ monopropyl ethers, $(POP)_{1-8}$ monobutyl ethers, $(POP)_{1-8}$ monoisobutyl ethers, $(POP)_{1-8}$ monoallyl ethers, $(POP)_{1-8}$ monohexyl ethers, $(POP)_{1-8}$ mono-2-ethylhexyl ethers, $(POP)_{1-8}$ monooctyl ethers, and the like. Incidentally, (POP) is an abbreviation similar to (POE) except for changing an ethylene unit to a propylene unit.

Propylene glycol diethers, such as $(POP)_{1-8}$ dimethyl ethers, $(POP)_{1-8}$ diethyl ethers, $(POP)_{1-8}$ dipropyl ethers, $(POP)_{1-8}$ dibutyl ethers, $(POP)_{1-8}$ diisobutyl ethers, $(POP)_{1-8}$ diallyl ethers, $(POP)_{1-8}$ ethyl methyl ethers, $(POP)_{1-8}$ butyl methyl ethers, $(POP)_{1-8}$ 2-ethylhexyl methyl ethers, $(POP)_2$ isopropyl methyl ether, $(POP)_2$ isopropyl ethyl ether, and the like.

Ethylene glycol monoether acetates, such as $(POE)_{1-8}$ monomethyl ether acetates, $(POE)_{1-8}$ monoethyl ether acetates, $(POE))_{1-8}$ monopropyl ether acetates, $(POE)_{1-8}$ monobutyl ether acetates, $(POE)_{1-8}$ monoisobutyl ether acetates, $(POE)_{1-8}$ monoallyl ether acetates, $(POE)_{1-8}$ monohexyl ether acetates, $(POE)_{1-8}$ mono-2-ethylhexyl ether acetates, $(POE)_{1-8}$ monooctyl ether acetates, and the like.

Propylene glycol monoether acetates, such as $(POP)_{1-8}$ monomethyl ether acetates, $(POP)_{1-8}$ monoethyl ether acetates, $(POP)_{1-8}$ monopropyl ether acetates, $(POP)_{1-8}$ monobutyl ether acetates, $(POP)_{1-8}$ monoisobutyl ether acetates, $(POP)_{1-8}$ monoallyl ether acetates, $(POP)_{1-8}$ monohexyl ether acetates, $(POP)_{1-8}$ mono-2-ethylhexyl ether acetates, $(POP)_{1-8}$ monooctyl ether acetates, and the like.

Butylene glycol monoethers, butylene glycol diethers, and butylene glycol monoether acetates, where butylene oxide is added in place of adding ethylene oxide or propylene oxide as above.

Among the above alkylene oxide compounds, from the aspects of detergency, rinsability after cleaning process, and compatibility when formulating other components, such as alkali metal oxides and water, a preference is given to the following compounds:

$(POE)_{1-5}$ monomethyl ethers, $(POE)_{1-5}$ monoethyl ethers, $(POE)_{1-5}$ monopropyl ethers, $(POE)_{1-5}$ monobutyl ethers, $(POE)_{1-2}$ monoisobutyl ethers, $(POE)_{1-2}$ monoallyl ethers, $(POE)_{1-2}$ monohexyl ethers, and $(POE)_{1-2}$ mono-2-ethylhexyl ethers;

$(POE)_{1-4}$ dimethyl ethers, $(POE)_{1-2}$ diethyl ethers, $(POE)_{1-2}$ dipropyl ethers, $(POE)_{1-2}$ dibutyl ethers, $(POE)_{2-3}$ ethyl methyl ethers, $(POE)_{2-3}$ butyl methyl ethers, and $(POE)_{2-3}$ 2-ethylhexyl methyl ethers;

$(POP)_{1-3}$ monomethyl ethers, $(POP)_{1-3}$ monoethyl ethers, $(POP)_{1-3}$ monopropyl ethers, $(POP)_{1-3}$ monobutyl ethers, and $(POP)_{1-3}$ monohexyl ethers;

$(POP)_{1-3}$ dimethyl ethers, $(POP)_{1-2}$ diethyl ethers, $(POP)_{1-2}$ dipropyl ethers, $(POP)_{1-2}$ dibutyl ethers, $(POP)_2$ isopropyl methyl ether, and $(POP)_2$ isopropyl ethyl ether;

$(POE)_{1-2}$ monomethyl ether acetates, $(POE)_{1-2}$ monoethyl ether acetates, $(POE)_{1-2}$ monopropyl ether acetates, and $(POE)_{1-2}$ monobutyl ether acetates; and $(POP)_1$ monomethyl ether acetate and $(POP)_1$ monoethyl ether acetate.

Incidentally, these alkylene oxide compounds may be used alone or in a combination.

The above alkylene oxide compounds may be prepared by a process comprising treating an alcohol having an alkyl group having 1 to 8 carbon atoms or allyl group with alkylene oxides having 2 to 4 carbon atoms under heating in the presence of a catalyst such as sodium hydroxide, and the like, the alkylene oxides including ethylene oxide, propylene oxide, butylene oxide, and the like which are supplied in a liquid or vapor form. Also, those whose alkylene oxide adducts whose terminus hydroxyl group is alkylated by an alkyl chloride or those esterified by acetic acid may be also used.

In Detergent Composition [A] for removing resinous stains, the amount of Component (a) is from 50 to 95% by weight, preferably from 65 to 90% by weight, particularly from 75 to 85% by weight, and the amount of Component (b) is from 5 to 50% by weight, preferably from 10 to 35% by weight, particularly from 15 to 25% by weight. From the aspect of exhibiting the removability of the resinous stains, it is preferred that the amount of Component (a) is not less than 50% by weight, and from the aspect of inhibiting a decrease in rinsability, the amount of Component (a) is not more than 95% by weight. From the aspect of inhibiting a decrease in rinsability, the amount of Component (b) is not less than 5% by weight, and from the aspect of exhibiting the removability of the resinous stains, it is preferred that the amount of Component (b) is not more than 50% by weight.

Detergent Composition [A] of the present invention may further comprise one or more water-soluble polyhydric alcohols in order to improve the removability of the resinous stains, the rinsability after cleaning process, and the compatibilities when formulating other components such as water.

The water-soluble polyhydric alcohols may be alcohols having 2 to 3 alcoholic hydroxyl groups wherein at least 20 g of the alcohol can be dissolved in 100 g of water at 25° C. From the aspects of polarity and melting point, those having not more than 3 alcoholic hydroxyl groups are preferred.

Concrete examples of the water-soluble polyhydric alcohols include the following compounds:

(1) Ethylene glycols, such as ethylene glycol, diethylene glycol, triethylene glycol, tetraethylene glycol, pentaethylene glycol, hexaethylene glycol, heptaethylene glycol, octaethylene glycol, nonaethylene glycol, decaethylene glycol, and the like.

(2) Propylene glycols, such as propylene glycol, dipropylene glycol, tripropylene glycol, and the like.

(3) Diols, such as 1,2-propanediol, 1,3-propanediol, 2-methyl-1,3-propanediol, 2,2-dimethyl-1,3-propanediol, 2-ethyl-2-methyl-1,3-propanediol, 2,2-diethyl-1,3-propanediol, 2-methyl-2-propyl-1,3-propanediol, 2-butyl-2-ethyl-1,3-propanediol, 1,2-butanediol, 1,3-butanediol, 1,4-butanediol, 2,3-butanediol, 3,3-dimethyl-1,2-butanediol, pinacol, 1,4-butenediol, 1,2-pentanediol, 1,4-pentanediol, 1,5-pentanediol, 2,4-pentanediol, 2-methyl-2,4-pentanediol, 2,4-dimethyl-2,4-pentanediol, 2,2,4-trimethyl-1,3-pentanediol, 1,2-hexanediol, 1,5-hexanediol, 1,6-hexanediol, 2,5-hexanediol, 2-methyl-1,3-hexanediol, 2,5-dimethyl-2,5-hexanediol, and the like.

(4) Triols, such as glycerol.

Among the above polyhydric alcohol compounds, from the aspects of removability of resinous stains, rinsability after cleaning process, compatibility when formulating other components such as water, and the like, and availability, a preference is given to those water-soluble dihydric alcohols having fairly linear molecular structures, each having one hydroxyl group each near both termini of a molecule, including ethylene glycol, diethylene glycol, triethylene glycol, tetraethylene glycol, pentaethylene glycol, hexaethylene glycol, heptaethylene glycol, octaethylene glycol, nonaethylene glycol, decaethylene glycol, propylene glycol, dipropylene glycol, tripropylene glycol, 1,2-propanediol, 1,3-propanediol, 2-methyl-1,3-propanediol, 1,3-butanediol, 1,4-butanediol, 1,4-butenediol, 1,4-pentanediol, 1,5-pentanediol, 1,5-hexanediol, 1,6-hexanediol, and the like.

These water-soluble polyhydric alcohols may be used alone or in combination.

The amount of the above water-soluble polyhydric alcohols in Detergent Composition [A] is not particularly limited. It is desired that the amount of the water-soluble polyhydric alcohols is from 1 to 81 parts by weight, preferably from 5 to 25 parts by weight, based on 100 parts by weight of the total content of Component (a) and Component (b) in Detergent Composition [A] of the present invention. From the aspect of showing sufficient effects of adding the water-soluble polyhydric alcohols, the amount of the water-soluble polyhydric alcohol is preferably not less than 1 part by weight, and from the aspect of inhibiting a decrease in removability of the resinous stains, the amount is preferably not more than 81 parts by weight.

Detergent Composition [A] may be employed in a non-aqueous system, or it may be diluted to a suitable concentration with water. When diluted with water, the amount of water is not particularly limited. From the aspects of safety and removability, the preferred amount of water is from 3 to 15 parts by weight, more preferably from 5 to 12 parts by weight, based on 100 parts by weight of the detergent composition. The kinds of water usable for dilution is not particularly limited as long as the effects of Detergent Composition [A] of the present invention are not impaired. Concrete examples thereof include ultra-pure water, pure water, ion-exchanged water, distilled water, usual tap water, and the like.

In Detergent Composition [A] of the present invention may further include, as occasion demands, one or more members of the following ingredients usually employed in detergents in amounts so as not to impair the effects of the present invention: Compounds having chelating abilities, including aminocarboxylic acids, such as hydroxyethyl aminoacetic acid, hydroxyethyl iminodiacetic acid, ethylenediamine tetracetic acid, and the like, or salts thereof; preservatives; anticorrosive agents; defoaming agents, such as silicones, and the like; antioxidants; amine compounds, such as amine compounds having 1 to 5 nitrogen atoms with a molecular weight of from 50 to 300, alkanolamines, morpholines, cyclic amines, polyamines, and linear or branched alkylamines; esters, such as methyl ester of coconut fatty acid and benzyl acetate; hydrocarbon solvents; and alcohols.

Detergent Composition [A] may be produced by blending Component (a) and Component (b), and optionally one or more water-soluble polyhydric alcohols and optional ingredients by conventional method.

Detergent Composition [B]

Component (a) and Component (b) usable in Detergent Composition [B] may be the same ones as Component (a) and Component (b) usable in Detergent Composition [A].

Concrete examples of Component (c), the alkali metal hydroxides include lithium hydroxide, sodium hydroxide, potassium hydroxide, and the like, with a preference given to sodium hydroxide and potassium hydroxide. These alkali metal hydroxides may be used alone or in combination.

Component (d), water, is used as a solvent for uniformly dissolving Component (c), the alkali metal hydroxides. The water used herein is not particularly limited as long as the effects of Detergent Composition [B] of the present invention are not impaired. Concrete examples thereof include ultra-pure water, pure water, ion-exchanged water, distilled water, usual tap water, and the like.

In Detergent Composition [B] for removing resinous stains, the amount of Component (a) is from 10 to 94% by weight, preferably from 20 to 80% by weight, particularly from 30 to 66% by weight. The amount of Component (b) is from 0.5 to 47% by weight, preferably from 4 to 33% by weight, particularly from 6 to 22% by weight. The amount of Component (c) is from 0.5 to 30% by weight, preferably from 1 to 20% by weight, particularly from 3 to 15% by weight. The amount of Component (d) is from 5 to 80% by weight, preferably from 15 to 60% by weight, particularly from 25 to 40% by weight.

From the aspect of exhibiting the removability of the resinous stains, it is preferred that the amount of Component (a) is not less than 10% by weight, and from the aspect of inhibiting a decrease in rinsability, the amount of Component (a) is not more than 94% by weight. From the aspect of inhibiting a decrease in rinsability, the amount of Component (b) is not less than 0.5% by weight, and from the aspect of exhibiting the removability of the resinous stains, it is preferred that the amount of Component (b) is not more than 47% by weight. From the aspect of exhibiting the removability of the resinous stains, it is preferred that the amount of Component (c) is not less than 0.5% by weight, and from the aspects of increasing the uniformness of the product and inhibiting danger of handling alkalis, it is preferred that the amount of Component (c) is not more than 30% by weight. From the aspect of giving removability of the resinous stains owing to its peeling effects, it is preferred that the amount of Component (d) is not less than 5% by weight, and from the aspects of giving removability of the resinous stains owing to swelling dissolution of the resinous stains, it is preferred that the amount of Component (d) is not more than 80% by weight.

In addition, in Detergent Composition [B], the proportion of Component (a) to Component (b) is not particularly limited. It is desired that the weight ratio of Component (a) to Component (b) is from 50:50 to 95:5, preferably from 65:35 to 90:10, particularly from 75:25 to 85:15.

Detergent Composition [B] of the present invention may further comprise one or more water-soluble polyhydric alcohols in order to improve the removability of the resinous stains, the rinsability after cleaning process, and the compatibilities when formulating other components such as water. Concrete examples of the water-soluble polyhydric alcohols may be the same ones listed as the water-soluble polyhydric alcohols in Detergent Composition [A]. These water-soluble polyhydric alcohols may be used alone or in combination.

The amount of the above water-soluble polyhydric alcohols in Detergent Composition [B] is not particularly limited. It is desired that the amount of the water-soluble polyhydric alcohols is from 1 to 81 parts by weight, preferably from 5 to 25 parts by weight, based on 100 parts by weight of the total content of Component (a) and Component (b) in Detergent Composition [B] of the present invention. From the aspect of showing sufficient effects of adding the water-soluble polyhydric alcohols, the amount of the water-soluble polyhydric alcohol is preferably not less than 1 part by weight, and from the aspect of inhibiting a decrease in removability of the resinous stains, the amount is preferably not more than 81 parts by weight.

In Detergent Composition [B] of the present invention may further include, as occasion demands, one or more members of the following ingredients usually employed in detergents in amounts so as not to impair the effects of the present invention: Compounds having chelating abilities, including aminocarboxylic acids, such as hydroxyethyl aminoacetic acid, hydroxyethyl iminodiacetic acid, ethylenediamine tetracetic acid, and the like, or salts thereof; preservatives; anticorrosive agents; defoaming agents, such as silicones, and the like; antioxidants; amine compounds, such as amine compounds having 1 to 5 nitrogen atoms with a molecular weight of from 50 to 300, alkanolamines, morpholines, cyclic amines, polyamines, and linear or branched alkylamines; esters, such as methyl ester of coconut fatty acid and benzyl acetate; hydrocarbon solvents; and alcohols.

Detergent Composition [B] may be produced by blending Component (a) to Component (d), and optionally one or more water-soluble polyhydric alcohols and optional ingredients by conventional method. In addition, Detergent Composition [B] of the present invention can be also obtained by blending a given ratio of Detergent Composition [A] of the present invention with an alkaline detergent.

The detergent compositions for removing resinous stains of the present invention, namely, Detergent Composition [A] and Detergent Composition [B], are suitably used to remove resinous stains which are from one or more members selected from the group consisting of plastic lens resins, adhesives, and tackifiers adhered to glass molds, jigs and tools usable in the production process of the plastic lens.

2. Process for removing resinous stains of the present invention

The process for removing resinous stains comprising the steps of cleaning an object to which resinous stains are adhered using the detergent composition of the present invention, thereby removing the resinous stains from the object.

There are two embodiments for the concrete process for removing resinous stains.

Embodiment 1) comprises:

(A) cleaning an object to which resinous stains are adhered using Detergent Composition [A];

(B) cleaning the cleaned object obtained in step (A) with an alkaline detergent containing 0.5 to 30% by weight of an alkali metal hydroxide; and (C) rinsing the cleaned object obtained in step (B) with rinsing water.

Embodiment 2) comprises:

(D) cleaning an object to which resinous stains are adhered using Detergent Composition [B]; and (E) rinsing the cleaned object obtained in step (D) with rinsing water.

Embodiment 1)

Step (A) comprises cleaning an object to which resinous stains are adhered using Detergent Composition [A]. The cleaning process usable in this step is not particularly limited, and any of conventionally known methods may be used. Concrete examples for cleaning process include various cleaning processes employing immersion method, ultrasonic cleaning method, fluidized immersion method, spraying method, and the like. In addition, the cleaning conditions, such as temperature of the detergent compositions and cleaning period of time, are not particularly limited. The conditions may be suitably chosen depending upon the kinds of resinous stains, modes of adhesion, constituting components of resinous stains, polymerization states of resinous stains, amount of resinous stains adhered, location adhered, states of adhesion, materials of the cleaning objects, extent of removability required, capacity of the washing machines, period of time allowed for cleaning, and the like.

Step (B) comprises cleaning the cleaned object obtained in step (A) with an alkaline detergent containing 0.5 to 30% by weight of an alkali metal hydroxide. The cleaning process usable in this step is not particularly limited, and a similar process to that of step (A) may be employed. In addition, the cleaning conditions are not particularly limited, and they may be suitably chosen.

The alkaline detergents usable in the present invention are not particularly limited, and any of conventional alkaline detergents may be used as long as they include from 0.5 to 30% by weight of an alkali metal hydroxide. In addition, it is desired that the alkaline detergent is an aqueous solution whose water content is from 5.0 to 99.5% by weight. Concrete examples of the alkali metal hydroxides usable herein include lithium hydroxide, sodium hydroxide, potassium hydroxide, and the like, with a preference given to sodium hydroxide and potassium hydroxide. These alkali metal hydroxides may be used alone or in combination.

It is desired that the amount of the alkali metal hydroxides in the above alkaline detergent is from 0.5 to 30% by weight, preferably from 1 to 20% by weight, particularly from 3 to 15% by weight. From the aspect of exhibiting detergency, it is desired that the amount of the alkali metal hydroxides is not less than 0.5% by weight, and from the aspect of inhibiting corrosion of glass molds, it is desired that the amount is not more than 30% by weight.

The alkaline detergents may further include, as occasion demands, the following known ingredients usually usable in conventional detergents: Surfactants, such as anionic surfactants, cationic surfactants, nonionic surfactants, and amphoteric surfactants; compounds having chelating abilities, including aminocarboxylic acids, such as hydroxyethyl aminoacetic acid, hydroxyethyl iminodiacetic acid, ethylenediamine tetracetic acid, and the like, or salts thereof; metal ion capturing agents; preservatives; anticorrosive agents; defoaming agents, such as silicones, and the like; antioxidants; amine compounds, such as amine compounds having 1 to 5 nitrogen atoms with a molecular weight of from 50 to 300, alkanolamines, morpholines, cyclic amines, polyamines, and linear or branched alkylamines; esters, such as methyl ester of coconut fatty acid and benzyl acetate; hydrocarbon solvents; and alcohols.

Step (C) comprises rinsing the cleaned object obtained in step (B) with rinsing water. The rinsing water is not particularly limited, as long as it is capable of removing the stained products remaining on the surfaces of the cleaning object. From the aspect of rinsability, ultra-pure water, pure water, ion-exchanged water, distilled water, usual tap water, and the like may be suitably used. In addition, the rinsing process is not particularly limited, and a process similar to the cleaning process in step (A) may be employed. Moreover, the rinsing conditions are not particularly limited, and the conditions may be suitably chosen.

As described above, in this embodiment, the cleaning object is first cleaned with Detergent Composition [A] and subsequently with the alkaline detergent. By using the detergent compositions in a sequential order of Detergent Composition [A] and the alkaline detergent, it is made possible to cause flecking and dissolution of the resinous stains by Detergent Composition [A], and thereafter to cause peeling of the resinous stains by the alkaline detergents. Therefore, extremely high removability effects of the resinous stains can be exhibited.

Embodiment 2)

Step (D) comprises cleaning an object to which resinous stains are adhered using Detergent Composition [B]. The cleaning process usable in this step is not particularly limited, and a conventional process similar to that of step (A) may be employed. In addition, the cleaning conditions, such as temperature of the detergent compositions and cleaning period of time, are not particularly limited. The conditions may be suitably chosen depending upon the kinds of resinous stains, modes of adhesion, constituting components of resinous stains, polymerization states of resinous stains, amount of resinous stains adhered, location adhered, states of adhesion, materials of the cleaning objects, extent of removability capacity of the washing machines, period of time allowed for cleaning, and the like.

Step (E) comprises rinsing the cleaned object obtained in step (D) with rinsing water. The rinsing water is not particularly limited, as long as it is capable of removing the stained products remaining on the surfaces of the cleaning object. From the aspect of rinsability, ultra-pure water, pure water, ion-exchanged water, distilled water, usual tap water, and the like may be suitably used. In addition, the rinsing process is not particularly limited, and a process similar to the cleaning process of step (A) may be employed. Moreover, the rinsing conditions are not particularly limited, and the conditions may be suitably chosen.

In this embodiment, since the components causing flecking and dissolution of the resinous components and the components causing peeling of the resinous stains are all in one detergent composition (Detergent Composition [B]), the resinous stains can be removed in a single cleaning vessel.

The method for removing resinous stains of the present invention exhibits excellent detergency against resinous stains which are adhered to surfaces of hard materials and difficult to be removed. The resinous stains adhered to surfaces of hard materials include 1) resins, such as plastic lens resins, adhesives, tackifiers, and the like, adhered to optical parts, such as plastic lens, or resinous materials, and to glass molds, jigs and tools usable in the production processes of the plastic lens; 2) paints, such as body coatings upon color changes in automobile production, paints adhered to jigs for painting, paints for automobile bumpers for recycling and reuse, paints for constructions, such as sash made of aluminum and buildings; 3) ink cured products adhered to printing machines during printing, such as gravure, and the like; 4) resists using producing electronic parts or for metal process products, such as semiconductors and lead-frames; 5) resins such as adhesives for temporary fixing, fixing agents, bonding agents, sealing agents, and the like, which are adhered to semiconductor and crystalline materials such as silicon, gallium arsenide, and gallium phosphide, electronic part-related materials such as crystals, quartz, glass, and piezoelectric element, magnetic materials such as ferrite and samarium cobalt, magnetic member materials such as magnetic heads, electronic parts such as chip-type electronic parts, electric parts or precision machine parts, such as liquid crystal color filters and printed wiring boards, or adhered to jigs and tools usable in the processing and production processes thereof; and 6) resins, such as binders, paints, and protective films removed during recycling of the above parts. In particular, the process of the present invention is suitably utilized in the removal of resinous stains on plastic lens resins which have been considered most difficult kind to be removed adhered to the glass molds during the production process of plastic lens.

More concretely, the process for removing resinous stains of the present invention is particularly suitably utilized when the object to be cleaned is plastic lens or glass molds, jigs and tools usable in the production process of the plastic lens, and when the resinous stains are from one or more members selected from the group consisting of plastic lens resins, adhesives, and tackifiers.

EXAMPLES

The present invention will be described hereinbelow by means of the following examples, without intending to limit the spirit or scope of the present invention thereto.

Examples 1 to 27 and Comparative Examples 1 to 29

Each of the detergent compositions having the composition shown in Tables 1 to 5 (compositional ratio being expressed by % by weight) was prepared, and the detergency of each of these detergent compositions alone or a combination or these detergent compositions, or a mixture thereof was evaluated by removability as detailed below. The results are shown in Tables 6 to 11.

Preparation of Test Pieces for Removability Test

1. Test pieces with resinous stains of diethylene glycol bis(allyl carbonate) (ADC)

A glass-made, three-hole slide glass (manufactured by Iuchi Seieido Co., Ltd.) with three small watch-glass like dents, each having a diameter of 20 mm and a maximum depth of 2 mm, the slide glass having dimensions of 4.7 mm×75.4 mm×26.0 mm, was furnished. One-hundred parts by weight of diethylene glycol bis(allyl carbonate) (hereinafter simply referred to "ADC") [CR-39 monomers manufactured by PPG Industries, Inc.) as monomeric components and 11 parts by weight of di-isopropyl peroxydicarbonate [PEROYL IPP-27 (CR) (manufactured by Nippon Oil and Fats Co., Ltd.)] as a polymerization initiator were mixed into a uniform mixture at a low temperature. The resulting mixture was poured in a volume of 0.22 mL in each of dents on the slide glass. In other words, the amount of the resin mixture poured per slide glass was 0.66 mL.

The slide glass with three, resin-mixture filled dents was placed in a tray with a lid. After filling the atmosphere with nitrogen gas, the tray was tightly sealed with the lid. Thereafter, the resin mixture was heated under sequential heat treatments of 40° C. for two hours, 60° C. for two hours, and 80° C. for 18 hours, to thereby polymerize the monomeric components and allow the resulting product to be solidified. The resulting test piece with ADC resinous stains was subjected to removability test.

2. Test pieces with urethane resinous stains

One-hundred parts by weight of 4,4'-methylenebis (phenylisocyanate) ["MILLIONATE MT" (manufactured by Nippon Polyurethane Industry Co., Ltd.) and 36.8 parts by weight of glycerol [purified glycerol (manufactured by Kao Corporation)] were mixed at a molar ratio of 1:1 at 40° C. under reduced pressure. A glass-made watch glass (manufactured by Corning Inc.) having a diameter of 100 mm and a maximum depth of 10 mm was charged with 0.5 mL of the resulting mixture. Further, this mixture-charged watch glass was placed in a tray with a lid. After filling the atmosphere with nitrogen gas dried with a drying agent, the tray was tightly sealed with the lid. Thereafter, the contents were heated under sequential heat treatments of 120° C. for two hours and 180° C. for five hours, to thereby polymerize the monomeric components and allow the resulting product to be solidified. The resulting test piece with the urethane resinous stains was subjected to the removability test.

Removability Test

Each of the test pieces for removability test for ADC resinous stains and for removability test for urethane resinous stains was dipped in one of the detergent compositions listed in Tables 6 to 11 kept at 60° C., and the test piece was cleaned with a ultrasonic cleaning device ("SILENTSONIC UT204," manufactured by Sharp Corporation) at 39 kHz and 200 W for 120 seconds.

In this test, in cases of Examples 1 to 10 and Comparative Examples 1 to 10 where a single detergent composition was used for cleaning, the cleaning was carried out in a single vessel for 120 seconds. In cases of Examples 11 to 20 and Comparative Examples 11 to 20 where cleaning was carried out in a sequential two-step cleaning process of Detergent Composition [A] and an alkaline detergent, cleaning was carried out in separate vessels for each of the detergents for 60 seconds, adding up to a total cleaning period of time to be 120 seconds. In cases of Examples 21 to 27 and Comparative Examples 21 to 28 where cleaning was carried out in a mixed system of Detergent Composition [A] and the alkaline detergent, cleaning was carried out in a single vessel for 120 seconds.

Next, the cleaned test piece was dipped in ion-exchanged water at 30° C., and subjected to rinsing (first rinsing) for 60 seconds with a ultrasonic cleaning device similar to that employed in the cleaning step. Further, in the same manner as above the rinsed test piece was dipped in separate ion-exchanged water at 30° C., and subjected to finishing rinsing (second rinsing) with the ultrasonic cleaning device for 60 seconds. Subsequently, the rinsed test piece was subjected to air blowing for one minute, and the resulting test piece was dried in a forced convection oven ("FV-630," manufactured by Toyo Seisakusho Co., Ltd.) at 80° C. for ten minutes.

Incidentally, in Comparative Example 29, cleaning was carried out in the same manner as above using methylene chloride (boiling point 40.2° C.) as a cleaning agent in a single vessel kept at a cleaning temperature of 35° C. for 120 seconds. Thereafter, the resulting test piece was dipped in methylene chloride (cleaning temperature: room temperature), and rinsing was carried out twice (first rinsing, second rinsing), each for 60 seconds using the above ultrasonic cleaning device. The rinsed test piece was air-dried in a room.

For each of the detergent compositions used, five test pieces for each of removability tests, namely five test pieces for ADC resinous stains and five test pieces for urethane resinous stains as prepared above, were cleaned under the above cleaning conditions to obtain removability percentage of each of resinous stains. Here, the removability percentage was calculated by a difference in weights of the test piece before and after cleaning, and an average value was taken as a removability (%).

The results are shown in Tables 6 and 11.

TABLE 1

| Detergent Components | Inventive Products Detergent Composition [B] | | | | | | | | | |
|---|---|---|---|---|---|---|---|---|---|---|
| (% by weight) | 1 | 2 | 3 | 4 | 5 | 6 | 7 | 8 | 9 | 10 |
| (a)Aromatic Compounds | | | | | | | | | | |
| Ethylbenzene | 45 | — | — | — | — | — | — | — | — | — |
| Benzyl Alcohol | — | — | 40 | — | — | 55 | — | — | — | — |
| β-Phenylethyl Alcohol | — | 60 | — | — | — | — | — | — | — | 20 |
| Benzyl Methyl Ether | — | — | — | 25 | — | — | — | — | — | — |
| Butyl Phenyl Ketone | — | — | — | — | — | — | 63 | — | — | — |
| $(POE)_1$ Monophenyl Ether | — | — | — | — | 90 | — | — | — | 60 | — |
| $(POP)_3$ Monobenzyl Ether | — | — | — | — | — | — | — | 35 | — | — |
| (b)Alkylene Oxide Compounds | | | | | | | | | | |
| $(POE)_4$ Monobutyl Ether | — | 5 | 4 | — | — | 8 | 3 | — | — | — |
| $(POE)_3$ Ethyl Methyl Ether | 35 | — | — | 5 | — | — | — | — | 10 | — |
| $(POP)_2$ Monohexyl Ether | — | — | — | 3 | — | 8 | — | 10 | — | — |
| $(POP)_3$ Dimethyl Ether | — | — | 3 | — | 3 | — | — | — | 7 | 10 |
| (c)Alkali Metal Hydroxides | | | | | | | | | | |
| Sodium Hydroxide | 5 | — | — | 7 | — | 3 | — | 15 | 5 | 4 |
| Potassium Hydroxide | — | 10 | 3 | — | 1 | — | 7 | — | — | — |
| (d)Water | | | | | | | | | | |
| Water | 15 | 25 | 50 | 60 | 6 | 18 | 20 | 35 | 8 | 46 |
| Water-Soluble Polyhydric Alcohols | | | | | | | | | | |
| Triethylene Glycol | — | — | — | — | — | 8 | — | — | — | 15 |
| Dipropylene Glycol | — | — | — | — | — | — | 7 | — | — | — |
| 1,5-Pentanediol | — | — | — | — | — | — | — | 5 | — | — |
| Glycerol | — | — | — | — | — | — | — | — | 10 | 5 |

TABLE 2

| Detergent Components | Inventive Products Detergent Composition [A] | | | | | | | | | |
|---|---|---|---|---|---|---|---|---|---|---|
| (% by weight) | 11 | 12 | 13 | 14 | 15 | 16 | 17 | 18 | 19 | 20 |
| (a)Aromatic Compounds | | | | | | | | | | |
| Ethylbenzene | — | — | 85 | — | — | — | — | — | — | — |
| Benzyl Alcohol | — | — | — | — | 80 | — | — | — | — | 35 |
| β-Phenylethyl Alcohol | — | — | — | — | — | — | 55 | — | — | — |
| Benzyl Methyl Ether | — | — | — | 65 | — | — | — | — | 58 | — |
| Butyl Phenyl Ketone | — | 55 | — | — | — | — | — | — | — | 15 |
| $(POE)_1$ Monophenyl Ether | — | — | — | — | — | 85 | — | — | — | — |
| $(POP)_3$ Monobenzyl Ether | 93 | — | — | — | — | — | — | 56 | — | — |
| (b)Alkylene Oxide Compounds | | | | | | | | | | |
| $(POE)_4$ Monobutyl Ether | — | — | — | 30 | — | — | — | — | 25 | — |
| $(POE)_3$ Ethyl Methyl Ether | — | 25 | — | — | 10 | — | — | 6 | — | — |
| $(POP)_2$ Monohexyl Ether | — | 20 | — | — | 10 | — | 10 | — | 12 | — |
| $(POP)_3$ Dimethyl Ether | — | — | — | 5 | — | — | 10 | — | — | 5 |
| $(POE)_2$ Monobutyl Ether Acetate | 7 | — | 15 | — | — | 5 | — | — | — | — |
| Water-Soluble Polyhydric Alcohols | | | | | | | | | | |
| Triethylene Glycol | — | — | — | — | — | 10 | — | 25 | — | — |
| Dipropylene Glycol | — | — | — | — | — | — | — | 13 | — | 15 |
| 1,5-Pentanediol | — | — | — | — | — | — | 15 | — | — | 30 |
| Glycerol | — | — | — | — | — | — | 10 | — | 5 | — |

60

TABLE 3

| Detergent Components | Comparative Products Detergent Composition [B] | | | | | | | | | |
|---|---|---|---|---|---|---|---|---|---|---|
| (% by weight) | 1 | 2 | 3 | 4 | 5 | 6 | 7 | 8 | 9 | 10 |
| (a)Aromatic Compounds, etc. | | | | | | | | | | |
| Benzyl Alcohol | — | — | 50 | — | — | — | — | — | — | — |
| β-Phenylethyl Alcohol | — | — | — | 8 | — | — | — | — | 5 | — |
| Benzyl Methyl Ether | — | — | — | — | 9 | — | — | — | — | 65 |
| Dodecylbenzene | 45 | — | — | — | — | — | — | — | — | — |
| Cyclohexyl Alcohol | — | — | — | — | — | — | — | 55 | — | — |
| Cyclohexyl Methyl Ether | — | — | — | — | — | — | 63 | — | — | — |
| $(POE)_{10}$ Monophenyl Ether | — | 4 | — | 7 | — | — | 3 | 8 | — | 7 |
| (b)Alkylene Oxide Compounds | | | | | | | | | | |
| $(POE)_4$ Monobutyl Ether | — | — | 7 | — | — | 3 | 8 | — | 7 | |
| $(POE)_3$ Ethyl Methyl Ether | 35 | — | — | — | 30 | 10 | — | — | 15 | — |
| $(POP)_2$ Monohexyl Ether | — | 3 | — | — | 25 | 7 | — | 8 | — | — |
| $(POE)_3$ Monodecyl Ether | — | — | 15 | — | — | — | — | — | — | — |
| (c)Alkali Metal Hydroxides | | | | | | | | | | |
| Sodium Hydroxide | 5 | — | — | — | 7 | 5 | — | 3 | 4 | — |
| Potassium Hydroxide | — | 3 | 10 | 15 | — | — | 7 | — | — | 0.3 |
| (d)Water | | | | | | | | | | |
| Water | 15 | 50 | 25 | 70 | 29 | 8 | 20 | 18 | 46 | 20 |
| Water-Soluble Polyhydric Alcohols | | | | | | | | | | |
| Triethylene Glycol | — | — | — | — | — | — | — | 8 | 20 | — |
| Dipropylene Glycol | — | — | — | — | — | — | 7 | — | — | — |
| 1,5-Pentanediol | — | — | — | — | — | — | — | — | — | 7.7 |
| Glycerol | — | — | — | — | — | 10 | — | — | 10 | — |

TABLE 4

| Detergent Components | Comparative Products Detergent Composition [A] | | | | | | | | | |
|---|---|---|---|---|---|---|---|---|---|---|
| (% by weight) | 11 | 12 | 13 | 14 | 15 | 16 | 17 | 18 | 19 | 20 |
| (a)Aromatic Compounds, etc. | | | | | | | | | | |
| Benzyl Alcohol | — | — | — | 45 | — | — | — | — | 35 | — |
| β-Phenylethyl Alcohol | — | — | — | — | — | — | — | — | — | 10 |
| Benzyl Methyl Ether | — | — | — | — | 35 | — | — | — | — | — |
| Dodecylbenzene | — | — | — | — | — | 50 | — | — | — | — |
| Cyclohexyl Alcohol | — | — | 80 | — | — | — | — | — | 15 | — |
| Cyclohexyl Methyl Ether | — | 65 | -. | — | — | — | — | 48 | — | — |
| $(POP)_{10}$ Monophenyl Ether | 93 | — | — | — | — | — | 85 | — | — | — |
| (b)Alkylene Oxide Compounds | | | | | | | | | | |
| $(POE)_4$ Monobutyl Ether | — | 30 | — | — | — | — | — | 25 | — | 20 |
| $(POE)_3$ Ethyl Methyl Ether | 7 | — | 10 | — | 65 | — | 5 | — | — | 15 |
| $(POP)_2$ Monohexyl Ether | — | 5 | 10 | — | — | 5 | — | 22 | — | — |
| $(POE)_3$ Monodecyl Ether | — | — | — | 25 | — | — | — | — | — | — |
| $(POE)_{10}$ Monobutyl Ether | — | — | — | 30 | — | — | — | — | 20 | — |
| Water-Soluble Polyhydric Alcohols | | | | | | | | | | |
| Triethylene Glycol | — | — | — | — | — | — | 10 | — | — | 25 |
| Dipropylene Glycol | — | — | — | — | — | 15 | — | — | 15 | 30 |
| 1,5-Pentanediol | — | — | — | — | — | 30 | — | — | 15 | — |
| Glycerol | — | — | — | — | — | — | — | 5 | — | — |

TABLE 5

| Components for Alkaline Detergents (% by weight) | Alkaline Detergents 1 | 2 | 3 | 4 | 5 | 6 | 7 |
|---|---|---|---|---|---|---|---|
| Alkali Metal Hydroxides | | | | | | | |
| Sodium Hydroxide | — | — | 18 | — | 5 | 7 | — |
| Potassium Hydroxide | 28 | 20 | — | 10 | — | — | 10 |
| Surfactants | | | | | | | |
| EMULGEN 123P 1) | — | — | 1.5 | — | — | — | — |
| NEOPELEX F-25 2) | — | — | — | — | — | 10 | — |
| PELEX NB-L 3) | — | 2 | — | — | — | — | — |
| PELEX SS-H 4) | — | — | — | 3 | — | — | 3 |
| Chelating Agents | | | | | | | |
| EDTA-Na 5) | — | — | — | — | — | 10 | — |
| Gluconic Acid | — | — | — | — | 5 | — | 3 |
| Water | | | | | | | |
| Water | 72 | 78 | 80.5 | 87 | 90 | 73 | 84 |

Remarks:

1): Polyoxyethylene(23)lauryl ether (manufactured by Kao Corporation).

2): Sodium dodecylbenzene sulfonate (manufactured by Kao Corporation).

3): Sodium alkylnaphthalene sulfonate (manufactured by Kao Corporation).

4): Sodium dodecyl diphenyl ether disulfonate (manufactured by Kao Corporation).

5): Sodium ethylenediamine tetracetate (Reagent).

TABLE 6

| Example Nos. | Detergent Composition Inventive Products | Removability (%) Against ADC Resinous Stains | Against Urethane Resinous Stains |
|---|---|---|---|
| 1 | 1 | 95 | 90 |
| 2 | 2 | 100 | 95 |
| 3 | 3 | 100 | 96 |
| 4 | 4 | 98 | 91 |
| 5 | 5 | 99 | 94 |
| 6 | 6 | 100 | 98 |
| 7 | 7 | 98 | 91 |
| 8 | 8 | 100 | 96 |
| 9 | 9 | 100 | 96 |
| 10 | 10 | 98 | 92 |

Remarks: The cleaning process being carried out in a single vessel system for each of the detergent compositions.

TABLE 7

| Example Nos. | Detergent Composition Inventive Products | Alkaline Detergents | Removability (%) Against ADC Resinous Stains | Against Urethane Resinous Stains |
|---|---|---|---|---|
| 11 | 11 | 2 | 96 | 91 |
| 12 | 12 | 3 | 95 | 90 |
| 13 | 13 | 4 | 95 | 90 |
| 14 | 14 | 5 | 98 | 93 |
| 15 | 15 | 6 | 100 | 98 |
| 16 | 16 | 7 | 100 | 98 |

TABLE 7-continued

| Example Nos. | Detergent Composition Inventive Products | Alkaline Detergents | Removability (%) Against ADC Resinous Stains | Against Urethane Resinous Stains |
|---|---|---|---|---|
| 17 | 17 | 1 | 98 | 93 |
| 18 | 18 | 5 | 97 | 93 |
| 19 | 19 | 6 | 97 | 92 |
| 20 | 20 | 7 | 100 | 98 |

Remarks: The cleaning process being carried out in a double vessel system for each of the detergent compositions.

TABLE 8

| Example Nos. | Detergent Composition | Weight Ratio | Removability (%) Against ADC Resinous Stains | Against Urethane Resinous Stains |
|---|---|---|---|---|
| 21 | Inventive Product 12<br>Alkaline Detergent 1 | 50:50 | 97 | 91 |
| 22 | Inventive Product 14<br>Alkaline Detergent 2 | 60:40 | 98 | 94 |
| 23 | Inventive Product 15<br>Alkaline Detergent 3 | 30:70 | 100 | 99 |
| 24 | Inventive Product 17<br>Alkaline Detergent 14 | 20:80 | 100 | 97 |
| 25 | Inventive Product 18<br>Alkaline Detergent 5 | 90:10 | 100 | 98 |
| 26 | Inventive Product 19<br>Alkaline Detergent 6 | 70:30 | 100 | 95 |
| 27 | Inventive Product 20<br>Alkaline Detergent 7 | 80:20 | 100 | 100 |

Remarks *): Weight ratio of Inventive Product to Alkaline Detergent.

**): The cleaning process being carried out by mixing the detergent components.

TABLE 9

| Comparative Example Nos. | Detergent Composition Comparative Products | Removability (%) Against ADC Resinous Stains | Against Urethane Resinous Stains |
|---|---|---|---|
| 1 | 1 | 68 | 41 |
| 2 | 2 | 69 | 42 |
| 3 | 3 | 79 | 67 |
| 4 | 4 | 76 | 59 |
| 5 | 5 | 79 | 71 |
| 6 | 6 | 69 | 45 |
| 7 | 7 | 72 | 43 |
| 8 | 8 | 71 | 45 |
| 9 | 9 | 78 | 70 |
| 10 | 10 | 76 | 65 |

Remarks: The cleaning process being carried out in a single vessel system for each of the detergent compositions.

TABLE 10

| Comparative Example Nos. | Detergent Composition: Comparative Products | Detergent Composition: Alkaline Detergents | Removability (%): Against ADC Resinous Stains | Removability (%): Against Urethane Resinous Stains |
|---|---|---|---|---|
| 11 | 11 | 2 | 65 | 43 |
| 12 | 12 | 3 | 61 | 40 |
| 13 | 13 | 4 | 63 | 41 |
| 14 | 14 | 5 | 76 | 65 |
| 15 | 15 | 6 | 79 | 71 |
| 16 | 16 | 7 | 62 | 41 |
| 17 | 17 | 1 | 63 | 42 |
| 18 | 18 | 5 | 60 | 40 |
| 19 | 19 | 6 | 75 | 63 |
| 20 | 20 | 7 | 79 | 70 |

Remarks: The cleaning process being carried out in a double vessel system for each of the detergent compositions.

TABLE 11

| Comparative Example Nos. | Detergent Composition | Weight Ratio* | Removability (%): Against ADC Resinous Stains | Removability (%): Against Urethane Resinous Stains |
|---|---|---|---|---|
| 21 | Comparative Product 11 Alkaline Detergent 1 | 50:50 | 70 | 47 |
| 22 | Comparative Product 12 Alkaline Detergent 2 | 60:40 | 73 | 45 |
| 23 | Comparative Product 14 Alkaline Detergent 3 | 30:70 | 79 | 71 |
| 24 | Comparative Product 16 Alkaline Detergent 4 | 60:40 | 69 | 43 |
| 25 | Comparative Product 17 Alkaline Detergent 5 | 70:30 | 70 | 47 |
| 26 | Comparative Product 19 Alkaline Detergent 6 | 80:20 | 80 | 71 |
| 27 | Comparative Product 20 Alkaline Detergent 7 | 60:40 | 73 | 60 |
| 28 | Comparative Product 14 Alkaline Detergent 6 | 95:5 | 77 | 65 |
| 29 | Methylene Chloride (Cleaning Temp.: 35° C., bp: 40.2° C.) | — | 88 | 43 |

Remarks *): Weight ratio of Inventive Product to Alkaline Detergent.

**): The cleaning process being carried out by mixing the detergent component for Comparative Examples 21–28, and the cleaning process being carried out in a single vessel system for Comparative Product 29.

It is clear from the above results that the method for removing resinous stains of the present invention using the detergent composition of the present invention effectively removes both the ADC resinous stains and the urethane resinous stains. On the other hand, in Comparative Examples using comparative products, the removability of the resinous stains according to both tests is notably inferior than that of the present invention. Further, since it is not required to use methylene chloride in the method for removing resinous stains using the detergent composition of the present invention, safety is greatly increased.

The detergent composition of the present invention has excellent removability and safety. Also, the method for removing resinous stains of the present invention has excellent removability against resinous stains. The detergent compositions of the present invention are also much safer.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A detergent composition for removing resinous stains comprising:

(a) 50 to 95% by weight of an aromatic compound represented by the general formula (1):

(1)

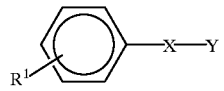

wherein $R^1$ is hydrogen atom or a hydrocarbon group having 1 to 4 carbon atoms; X is O, $CH_2O$, C═O, or $(CH_2)_k$; Y is OH, $R^2$, or $(R^3O)_jH$; $R^2$ is a hydrocarbon group having 1 to 7 carbon atoms; $R^3$ is an alkylene group having 2 to 3 carbon atoms; k is an integer of 1 or 2; and j is an integer of 1 to 8, provided that at least one of the groups represented by X and the groups represented by Y contains an oxygen atom or oxygen atoms; and (b) 5 to 50% by weight of an alkylene oxide compound represented by the general formula (2):

$$R^4—O—(R^5—O)_m—R^6,$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; and m is an integer of 1 to 8.

2. The detergent composition according to claim 1, further comprising a water-soluble polyhydric alcohol.

3. The detergent composition according to claim 1 or 2, wherein the resinous stains are from one or more members selected from the group consisting of plastic lens resins, adhesives, and tackifiers adhered to plastic lens or adhered to glass molds, jigs and tools usable in the production process of the plastic lens.

4. A detergent composition for removing resinous stains comprising:

(a) 10 to 94% by weight of an aromatic compound represented by the general formula (1):

(1)

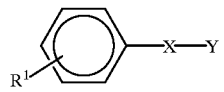

wherein $R^1$ is hydrogen atom or a hydrocarbon group having 1 to 4 carbon atoms; X is O, $CH_2O$, C═O, or $(CH_2)_k$; Y is OH, $R^2$, or $(R_3O)_jH$; $R^2$ is a hydrocarbon group having 1 to 7 carbon atoms; $R^3$ is an alkylene group having 2 to 3 carbon atoms; k is an integer of 1 or 2; and j is an integer of 1 to 8, provided that at least one of the groups represented by X and the groups represented by Y contains an oxygen atom or oxygen atoms; and (b) 0.5 to 47% by weight of an alkylene oxide compound represented by the general formula (2):

$$R^4—O—(R^5—O)_m—R^6,$$

wherein $R^4$ is an alkyl group having 1 to 8 carbon atoms or allyl group; $R^5$ is an alkylene group having 2 to 4 carbon atoms; $R^6$ is hydrogen atom, an alkyl group having 1 to 4 carbon atoms, an acyl group having 1 to 4 carbon atoms, or allyl group; and m is an integer of 1 to 8;

(c) 0.5 to 30% by weight of an alkali metal hydroxide; and (d) 5 to 80% by weight of water.

5. The detergent composition according to claim 4, further comprising a water-soluble polyhydric alcohol.

6. The detergent composition according to claim 4 or 5, wherein the resinous stains are from one or more members selected from the group consisting of plastic lens resins, adhesives, and tackifiers adhered to plastic lens or adhered to glass molds, jigs and tools usable in the production process of the plastic lens.

7. A process for removing resinous stains comprising the steps of:

(A) cleaning an object to which resinous stains are adhered using the detergent composition as defined in claim 1 or 2;

(B) cleaning the cleaned object obtained in step (A) with an alkaline detergent containing 0.5 to 30% by weight of an alkali metal hydroxide; and (C) rinsing the cleaned object obtained in step (B) with rinsing water.

8. The process according to claim 7, wherein the object to be cleaned is plastic lens or glass molds, jigs and tools usable in the production process of the plastic lens, and wherein the resinous stains are from one or more members selected from the group consisting of plastic lens resins, adhesives, and tackifiers.

9. A process for removing resinous stains comprising the steps of:

(D) cleaning an object to which resinous stains are adhered using the detergent composition as defined in claim 4 or 5; and (E) rinsing the cleaned object obtained in step (D) with rinsing water.

10. The process according to claim 9, wherein the object to be cleaned is plastic lens or glass molds, jigs and tools usable in the production process of the plastic lens, and wherein the resinous stains are from one or more members selected from the group consisting of plastic lens resins, adhesives, and tackifiers.

* * * * *